United States Patent [19]

Shurman

[11] 3,957,184

[45] May 18, 1976

[54] BACK PACK WITH RESILIENT BANDS FOR SPACING THE PACK FROM THE WEARER

[76] Inventor: Daniel A. Shurman, 6440 Valley View, Oakland, Calif. 94611

[22] Filed: Aug. 19, 1974

[21] Appl. No.: 498,406

[52] U.S. Cl. ..... 224/8 R

[51] Int. Cl.[2] ..... A45F 3/04

[58] Field of Search ..... 224/8 R, 8 A, 25 A, 224/9, 10, 11, 12; 190/51, 52; 150/33, 12

[56] References Cited

UNITED STATES PATENTS

| | | | |
|---|---|---|---|
| 1,692,115 | 11/1928 | Goldstein | 190/51 X |
| 3,860,157 | 1/1975 | Richards et al. | 224/25 A X |

FOREIGN PATENTS OR APPLICATIONS

| | | | |
|---|---|---|---|
| 30,448 | 2/1920 | Norway | 224/8 R |
| 79,582 | 9/1918 | Switzerland | 224/8 R |
| 173,120 | 5/1952 | Austria | 224/8 R |
| 80,433 | 3/1944 | Norway | 224/8 R |
| 1,355,725 | 2/1964 | France | 224/8 R |
| 70,732 | 12/1943 | Norway | 224/8 R |

*Primary Examiner*—Robert J. Spar
*Assistant Examiner*—Jerold M. Forsberg
*Attorney, Agent, or Firm*—Glenn E. Klepac

[57] ABSTRACT

A back pack including a bag provided with an internal frame comprising a pair of diagonally crossed blade-like bands secured to each other at a crossover zone, and secured to the bag by a pair of pockets at the upper extremities of the bands and by a pair of anchor pins at the lower extremities. The pack frame is given a slight arcuate curvature by tensioning strips impressing force between upper and lower extremities of the bands, and the tensioning strips are bridged by a mesh panel. Also included are a collapsible internal shelf and straps that can be used either as lashing straps for securing loads to the exterior of the pack or as load hauling straps for lifting and lowering the pack during climbing operations.

13 Claims, 14 Drawing Figures

BACK PACK WITH RESILIENT BANDS FOR SPACING THE PACK FROM THE WEARER

BACKGROUND OF THE INVENTION

This invention relates to light weight back packs carried by hikers and climbers for hauling gear.

Several types of back packs, both with and without frames, are known in the prior art. However, each of these prior art packs suffers from one or more serious disadvantages making it less than completely suitable for its intended purpose.

It is a principal object of the present invention to provide a back pack having a frame comprising a pair of interconnected blade-like bands crossed in an X-configuration, thereby producing a frame with a high strength-to-weight ratio.

It is a related object to provide means for fastening the bands of the frame to each other, and to a wall of a sack-like bag supported on the pack frame.

A further object is to provide tensioning strips for maintaining an arcuate curvature in the pack frame, thereby precluding direct contact between a bag supported on the frame and the wearer's back. The tensioning strips are bridged by a back-contacting mesh panel, to enhance wearer comfort.

Another object of the invention is to provide a carrying device for securing loads of varying sizes to the exterior of walls of a bag supported on the pack frame.

An additional object is to provide the bag with a flexible collapsible shelf fastened to the interior of the bag walls, thereby optionally dividing the bag into upper and lower compartments.

Still another object of the invention is to provide a pair of diagonally crossed load hauling straps for attachment of the pack to a bag suspension line during climbing operations. The same straps comprising the carrying device may also be used as load hauling straps.

BRIEF DESCRIPTIONS OF THE DRAWINGS

BRIEF DESCRIPTION OF THE PREFERRED EMBODIMENT

Figure 1:
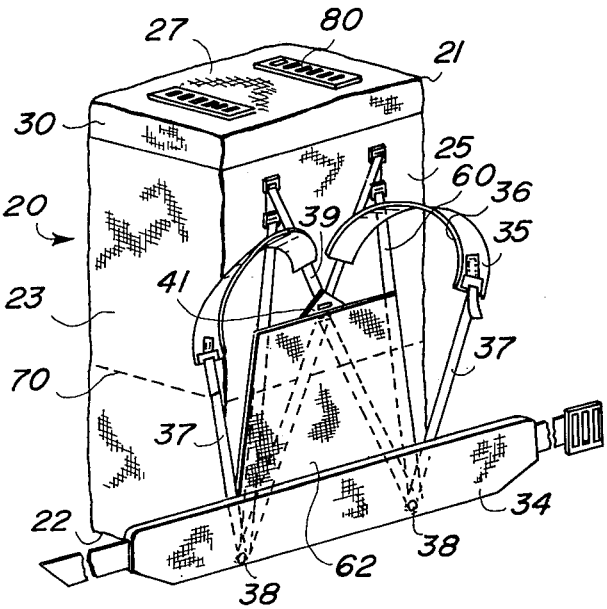
FIG. 1 is a front perspective view of a preferred embodiment of a back pack of the invention.
Figure 3:
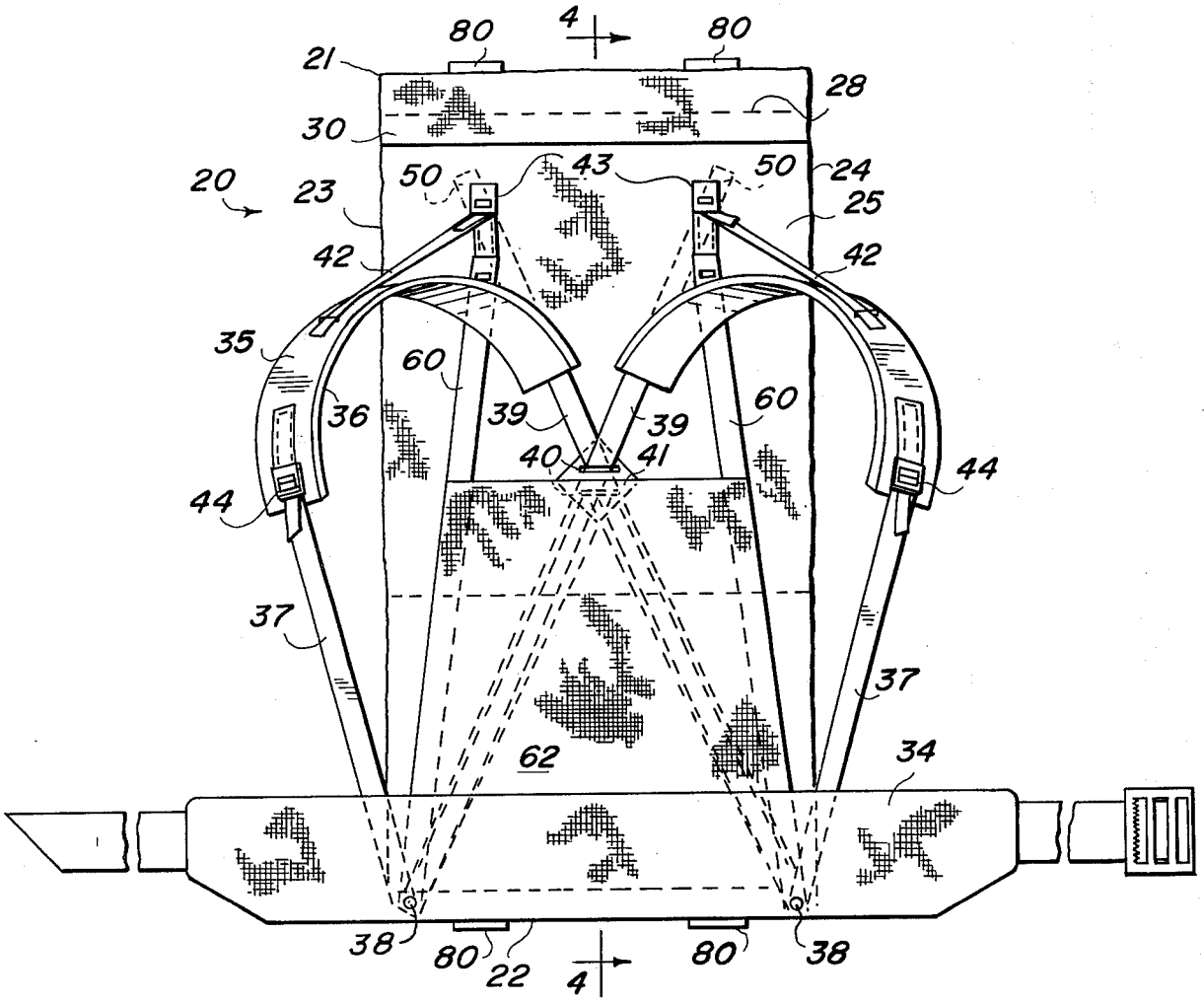
FIG. 3 is a front elevational view of the back pack of FIGS. 1 and 2.
Figure 5:
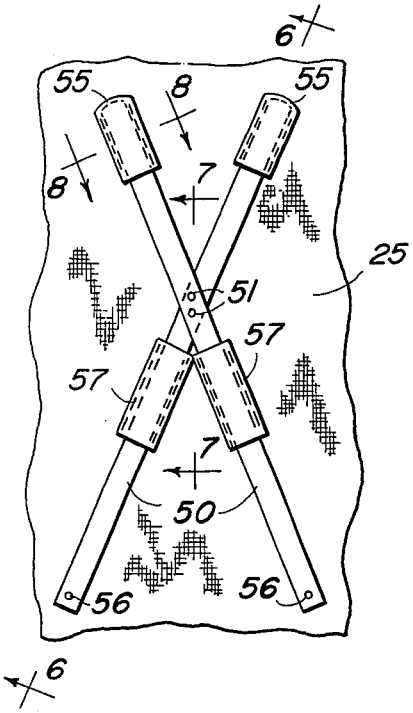
FIG. 5 is a fragmentary front elevational view of the interior of the front wall of a back pack of the invention.
Figure 4:
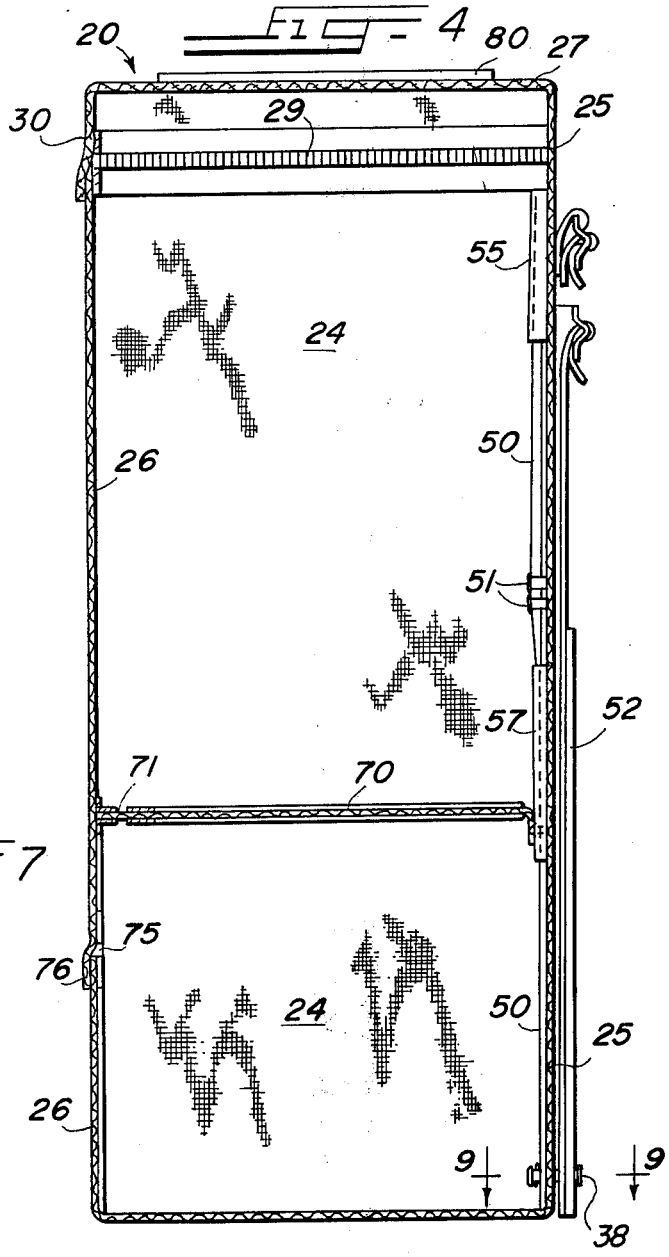
FIG. 4 is a fragmentary cross-sectional view taken along the lines 4—4 of FIG. 3.
Figure 6:
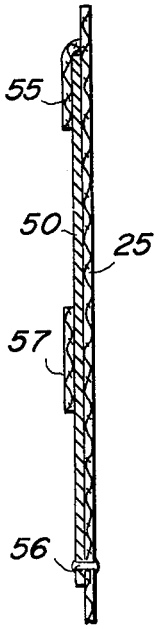
FIG. 6 is a cross-sectional view taken along the line 6—6 of FIG. 5.
Figure 7:
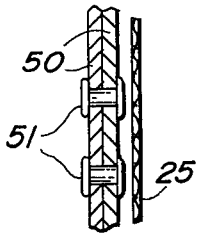
FIG. 7 is a cross-sectional view taken along the line 7—7 of FIG. 5.
Figure 8:
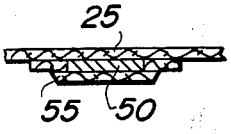
FIG. 8 is a cross-sectional view taken along the line 8—8 of FIG. 5.

Referring now to FIGS. 1, 3 and 4 of the drawings, the back pack 20 of the invention comprises a sack-like bag 21 having a floor 22, side walls 23 and 24, a front wall 25, a rear wall 26, and a closure 27 hinged to the front wall 25 along a horizontal hinge line 28. A zipper 29 releasably fastens the closure 27 to the side walls 23 and 24 and to the rear wall 26. A flap 30 hangs downwardly from the closure 27 to overlap the zipper 29. The bag 21 itself is preferably constructed of a medium weight Nylon fabric.

Figure 2:
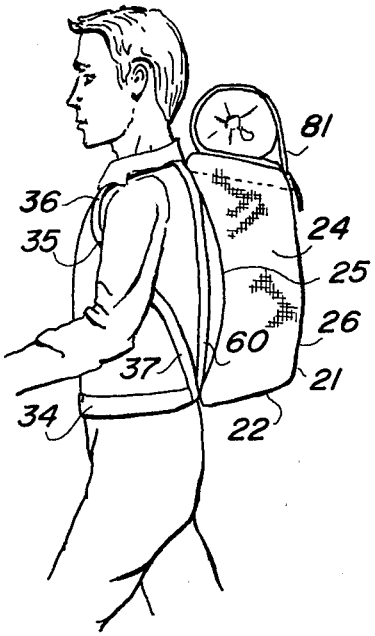
FIG. 2 is a side elevational view of a hiker carrying a back pack of the invention.

In FIGS. 1–3 it is seen that the back pack 20 is fastened to the body of a wearer by means of a waist belt 34 and a pair of shoulder straps 35 forming a shoulder harness. Each shoulder strap 35 includes a cushioned shoulder pad 36 to minimize wearer discomfort. The shoulder straps 35 are each attached to the front wall 25 of the bag 21 in three locations. A first connecting strap 37 is affixed to an anchor pin 38 extending forwardly of the front wall 25. A second connecting strap 39 is inserted through a pair of slits 40 formed in a leather patch 41 affixed to the front wall 25. The second connecting straps 39 cross each other at the leather patch 41 and extend diagonally downwardly to terminate on an anchor pin 38. Optionally, buckles (not shown) can be attached at the rear of each anchor pin 38 for adjustment of the lengths of the second connecting straps 39. A third connecting strap 42 (shown in FIG. 3) extends between a mid-point of an upper surface of the shoulder pad 36 and a buckle 43 affixed to the front wall 25. The length of this third strap 42 can be varied by adjustment at the buckle 43. The length of the first connecting strap is also adjustable at a buckle 44 affixed to the shoulder pad 36.

The front wall 25 of the bag 21 is reinforced by an internal metal frame, as shown in FIGS. 4–9. The frame includes a pair of crossed, blade-like aluminum bands 50 joined in their crossover zone by a pair of metal snaps 51 or rivets. The bands 50 may optionally be joined by epoxy glue or other fastening means. These bands are each 1 inch wide and ⅛ inch thick in the preferred embodiment illustrated.

The metal bands 50 of the frame are each joined to the front wall 25 in three locations. The upper extremities of the bands 50 each slidably seated within downwardly opening fabric-formed pockets 55 stitched to the inside of the front wall 25. Adjacent their lower extremities, the bands 50 are formed with openings 56 adapted to receive and to engage the anchor pin 38. A fabric sleeve 57 sewn to the inner surface of the front wall 25 receives the bands therethrough and secures the bands 50 to the front wall 25 intermediate the cross-over zone and the anchor pins 38.

It is an important feature of the invention that the X-frame may be arcuately deformed along its vertical expanse under tension applied thereto so that distortion force applied between the extremities of the bands 50 causes the center of the frame to arc away from the wearer's back. Such bending results in a slight curvature in and displacement of the front wall 25 of the pack, as shown in FIG. 2. When curvature is thus maintained in the front wall 25, a zone of spatial separation is established between the front wall 25 and the back of the wearer to ensure free air circulation between the pack itself and the wearer's back.

Deforming tension force is applied along the length of the bands 25 by means of a pair of heavy Nylon strips or strip means 60 extending between the anchor pins 38 and buckles 61 affixed to the front wall 25 of the bag 21. The tension maintained between extremities of the bands 50 can be conveniently varied, depending upon the degree of frame curvature desired.

Figure 9:
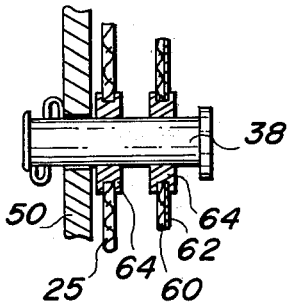
FIG. 9 is a cross-sectional view taken along the line 9—9 of FIG. 4.

An expanse between the Nylon strips 60 is bridged by an air-permeable relatively inextensible open mesh fabric panel 62. This panel 62 is adapted to bear upon the back of a wearer of the pack, thereby obviating discomfort that might result from direct contact between the wearer's back and the frame or walls of the pack. The Nylon strips 60, mesh panel 62, front wall 25, connecting straps 37 and 39, and belt 34 are each provided with metal grommets 64 adapted to engage upon the anchor pins 38, all as shown in FIG. 9.

Figure 13:
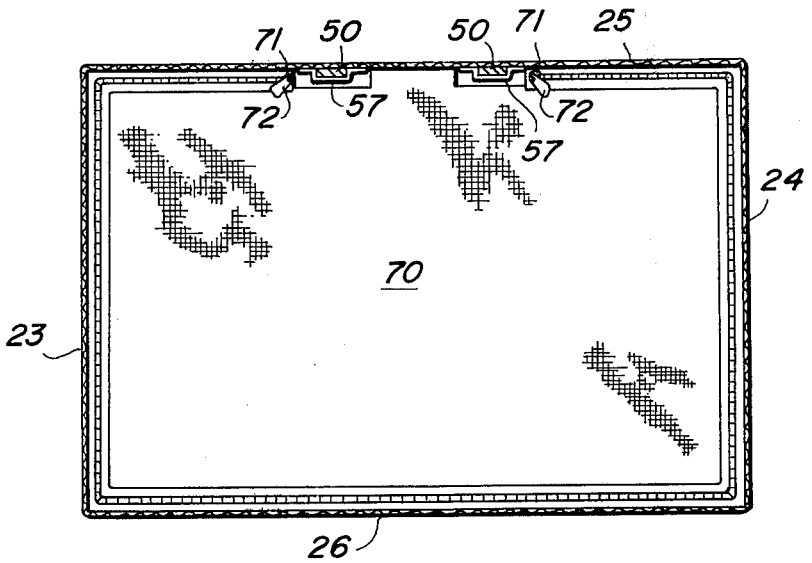
FIG. 13 is a cross-sectional view of FIG. 4, showing the zipper in a closed position.
Figure 14:
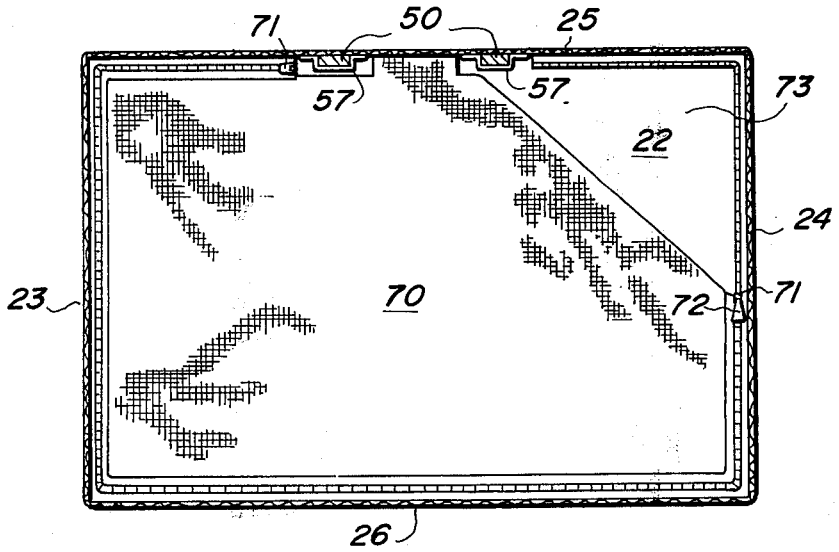
FIG. 14 is a cross-sectional view similar to FIG. 13, showing the zipper in a partially open position.

As illustrated in FIGS. 4, 13 and 14, the interior of the bag 21 is divided into upper and lower compartments by a flexible, collapsible fabric shelf 70. This shelf 70 is permanently secured to the front wall 25 along a horizontal line segment. The remainder of the perimetric margin of the shelf 70 is releasably secured to the walls by two slide fasteners or zippers 71. By imovement of the zippers 71, the shelf can be collapsed from its horizontal position shown in FIGS. 4 and 13 to a freely suspended generally vertical storage position (not shown) in which the upper and lower compartments of the bag are combined into a single, large compartment.

As shown in FIG. 14, the zippers 71 are each provided with manually actuable locks 72 allowing selective closure in a position intermediate a fully closed, shelf-supporting stance and an open position in which the upper and lower compartments are in communication with one another. With one of the zippers 71 thus locked in place there is formed a generally triangular opening 73 between the shelf 70 and the walls of the pack. This opening 73 establishes a compartment coextensive with the full height of the pack and adapted to house fishing poles, tent poles, ice picks and similarly shaped objects, which objects are too long to be contained in either the upper or lower compartments.

Access to the lower compartment of the bag is provided by a semi-circular zipper 75 in the rear wall 26. This zipper 75 is overlapped by a flap 76 attached to the rear wall 26.

Figure 10:
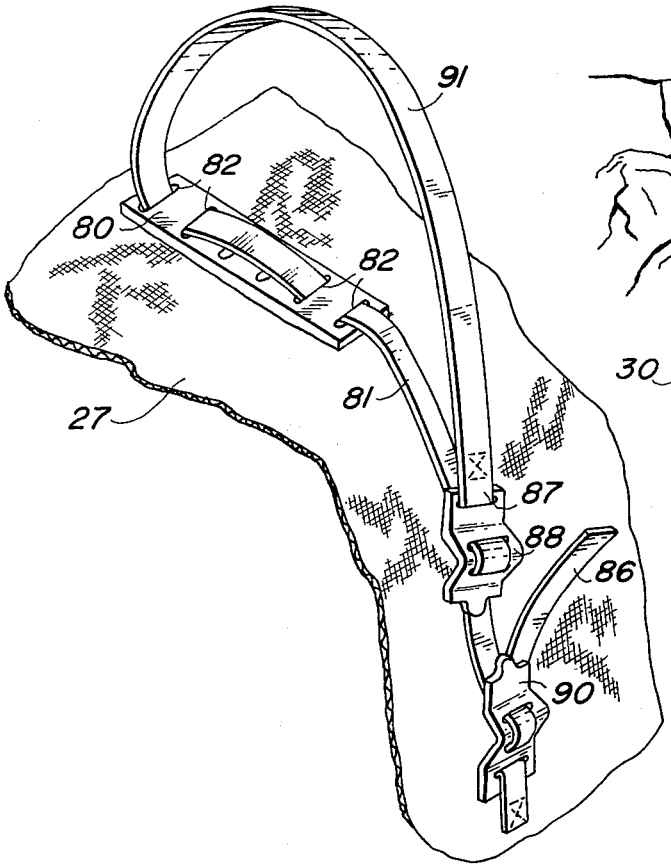
FIG. 10 is a rear perspective view of a preferred embodiment of a carrying device of the invention, affixed to a closure and to a rear wall of a back pack.

A carrying device for carrying loads outside the bag 21 is shown in FIG. 10. This device includes a leather web or patch 80 fixed to the top closure 27 of the bag 21, and a Nylon lashing strap 81. A perimetric edge portion of the leather patch 80 is sewn to the top closure 27, and the remainder of the patch is not attached. Six parallel transverse slits 82 are formed in the leather patch 80.

The Nylon lashing strap 81 has a free end 86 and a second end 87 to which a buckle 88 is attached. The free end 86 is inserted through the slits 82 in the leather patch 80, and then through two slots in the buckle 88 at the second end 87 of the strap 81. The free end 86 is finally fastened to another buckle 90 on the rear wall 26 of the bag 22. By varying the size of a looped portion 91 of the strap 81, and by selecting different slots for attachment of the strap 81 to the top closure 27, this carrying device is readily adaptable to secure loads of varying sizes to the pack. This feature eliminates objectionable forward or rearward slippage of the load as well as obviating any tendency for the load to roll or vibrate when the pack is transported on the back of a wearer.

As shown in FIG. 3, the floor 22 is similarly provided with a pair of leather patches 80 so that loads can be secured to the floor 22 as well as to the top closure 27.

Figure 11:
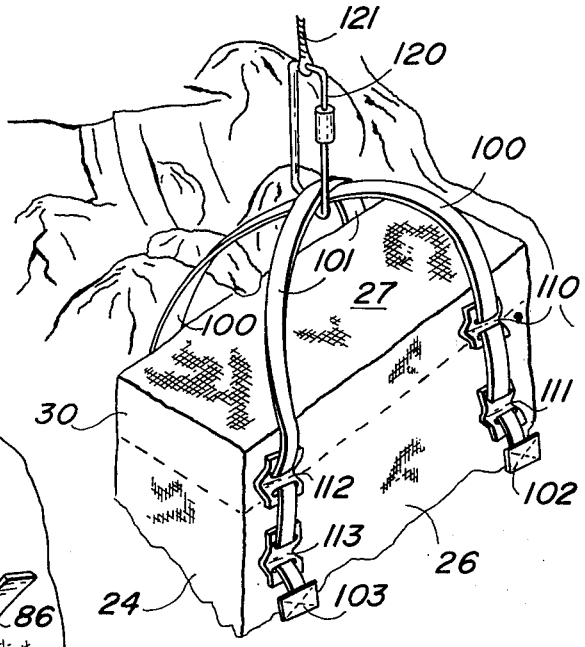
FIG. 11 is a fragmentary rear perspective view of a back pack of the invention, showing a pair of diagonally crossed load hauling straps coupled to a bag suspension line.
Figure 12:
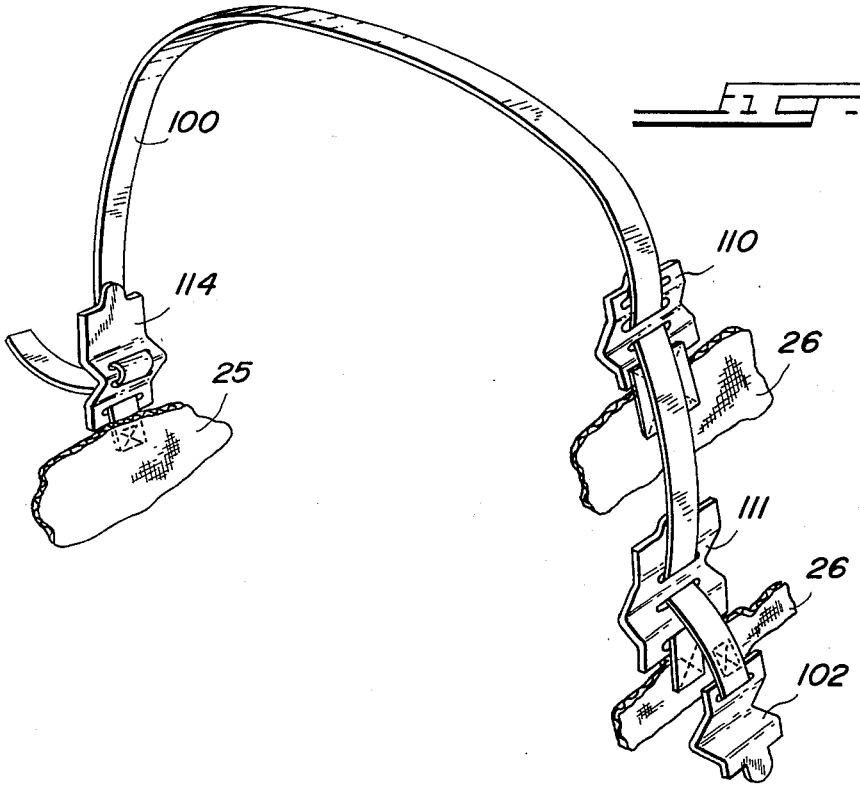
FIG. 12 is a fragmentary rear perspective view of one of the diagonally crossed carrying straps of FIG. 11.

The back pack also includes a pair of load hauling straps 100, 101 for use on climbing expeditions, as shown in FIGS. 11 and 12. The same lashing straps 81 that are included in the carrying device are adaptable for use as load hauling straps 100, 101. Each load hauling strap includes one free end and a second end affixed to a buckle 102, 103. The straps 100, 101 are each looped through a pair of the buckles 110, 111 and 112, 113 on the rear wall 26, and through one buckle 114 on the front wall 25. The straps 100, 101 bridge the bag diagonally, crossing one another above the center of the top closure 27. Where they cross, both straps 100, 101 are encircled by a clip or karabiner 120 attached to a bag suspension line 121. Because the straps are both readily slidable through the karabiner, the bag shifts readily in response to contact with rocks or other obstacles as the bag is raised and lowered. Delays that might be caused by entanglement with such obstacles are thereby avoided.

It will be understood by persons skilled in the art that numerous changes and modifications can be made in construction of the preferred embodiment of the back pack described herein, without departing from the spirit and scope of the invention as set forth in the following claims.

What is claimed is:

1. In a back pack of the type used by hikers and climbers as a body-carried container for transporting articles, said back pack including a sack-like bag having wall means including a floor, side wall means attached to, surmounting and extending upwardly of the floor, said side wall means including a front wall means oriented to face the back of a wearer of said back pack, and a closure for the bag;

frame means and means attaching said frame means flatly to said front wall means to impart structural rigidity to the bag and to obviate vertical collapse of said front wall means;

the improvement wherein said frame means comprises a pair of elongated, blade-like bands disposed contiguously to cross one another and to define an X-configuration at a crossover zone thereof, said bands being independent of auxiliary frame members interconnecting opposed upper and lower diagonally opposed extremities of the bands to one another;

a pair of fastening means interconnecting the bands to one another in the crossover zone to preclude scissors-like movement of the bands relative to each other; and means to maintain said bands in an arcuate curvature along the length thereof, thereby to provide a zone of spatial separation between the front wall means of the back pack and the back of a wearer of the back pack.

2. The structure as set forth in claim 1, wherein the means attaching said frame means to said front wall means comprises means securing each of opposed upper and lower diagonally opposed extremities of the bands to the front wall means of the bag.

3. The structure as set forth in claim 2, wherein the means securing the upper extremities of the bands to the front wall means comprise a pair of downwardly opening pocket means carried by the front wall means at laterally spaced positions, each of said pair of pocket means being adapted to receive and to retain therewithin a corresponding upwardly directed extremity of each of the bands of said frame means.

4. The structure as set forth in claim 2, wherein the means securing the lower extremities of the bands to the front wall means comprise a pair of laterally spaced anchor pin means carried by and extending substantially normally to said front wall means;

and wherein said bands are formed with openings therethrough adjacent lower extremities thereof, each said pin means projecting through a corresponding opening in said bands to secure said bands relative to said front wall means of the bag.

5. The structure as set forth in claim 1 wherein said means to maintain said bands in an arcuate curvature along the length thereof comprises a pair of strip means bridging said bands along the length thereof and disposed on a side of said front wall means opposed to said bands, said strip means constituting tensioning means for selectively impressing a tensioning force between upper and lower extremities of said blade-like bands to maintain an arcuate curvature along the length thereof.

6. The structure as set forth in claim 5, and further comprising an air-permeable sheet-like panel overlying an area disposed between said strip means and means attaching said panel to the strip means, said panel being adapted to engage and to bear upon the back of a wearer of said back pack, thereby to provide a zone of spatial separation between the front wall means of the back pack and the back of a wearer of the back pack.

7. The structure as set forth in claim 1, wherein said pair of fastening means interconnecting said bands to one another in the crossover zone comprise a pair of rivets passing through openings formed in both bands.

8. The structure as set forth in claim 1 and further comprising a flexible shelf disposed internally of said bag and adapted to extend thereacross intermediate upper and lower extremities thereof to divide the interior of said bag into upper and lower compartments, and slide fastener means releasably securing said shelf at a perimetric edge thereof to circumambient said wall means of said bag;

whereby said shelf is selectively adjustable between a wall means-supported, horizontal, bag-dividing position and a freely suspended, vertical storage position.

9. In a back pack of the type used by hikers and climbers as a body-carried container for transporting articles, said back pack including a sack-like bag having wall means including a floor, side wall means attached to, surmounting and extending upwardly of the floor, said side wall means including a front wall means oriented to face the back of a wearer of said back pack, and a closure for the bag; and frame means and means attaching said frame means flatly to said front wall means to impart structural rigidity to the bag and to obviate vertical collapse of said front wall means;

the improvement wherein said frame means comprises a pair of elongated, blade-like bands disposed contiguously to cross one another and to define an X-configuration at a crossover zone thereof, said bands being independent of auxiliary frame members interconnecting opposed upper and lower diagonally opposed extremities of the bands to one another, and means interconnecting the bands to one another in the crossover zone to preclude scissors-like movement of the bands relative to each other;

and wherein said back pack further comprises strip means bridging said bands along the length thereof and disposed on a side of said front wall means opposed to said bands, said strip means constituting a pair of strips for selectively impressing a tensioning force between upper and lower extremities of said blade-like bands to maintain an arcuate curvature along the length thereof, thereby to provide a zone of spatial separation between the front wall means of the back pack and the back of a wearer of the back pack.

10. The structure as set forth in claim 9, wherein the means attaching said frame means to said front wall means includes a pair of downwardly opening pocket means carried by the front wall means at laterally spaced positions, each of said pair of pocket means being adapted to receive and to retain therewithin a corresponding upwardly directed extremity of each of the bands of said frame means.

11. The structure as set forth in claim 9, wherein the means attaching the frame means to said front wall means includes a pair of laterally spaced anchor pin means carried by and extending substantially normally to said front wall means;

and wherein said bands are formed with openings therethrough adjacent lower extremities thereof, each said pin means projecting through a corresponding opening in said bands to secure said bands relative to said front wall means of the bag.

12. The structure as set forth in claim 9, wherein said means interconnecting said bands to one another in the crossover zone comprise a pair of rivets passing through openings formed in both bands.

13. In a back pack of the type used by hikers and climbers as a body-carried container for transporting articles, said back pack including a sack-like bag having wall means including a floor, side wall means attached to, surmounting and extending upwardly of the floor, said side wall means including a front wall means oriented to face the back of a wearer of said back pack, and a closure for the bag; and frame means and means attaching said frame means flatly to said front wall means to impart structural rigidity to the bag and to obviate vertical collapse of said front wall means;

the improvement wherein said frame means comprises a pair of elongated, blade-like bands disposed contiguously to cross one another and to define an X-configuration at a crossover zone thereof, and means interconnecting the bands to one another in the crossover zone to preclude scissors-like movement of the bands relative to each other;

and wherein said back pack further comprises strip means bridging said bands along the length thereof and disposed on a side of said front wall means opposed to said bands, said strip means comprising a pair of strips for selectively impressing a tensioning force between upper and lower extremities of said blade-like bands;

an air-permeable sheet-like panel overlying an area disposed between said strips; and means attaching said panel to said strips, said panel being adapted to engage and to bear upon the back of a wearer of said back pack, thereby to provide a zone of spatial separation between the front wall means of the back pack and the back of a wearer of the back pack.

* * * * *